US011325227B2

(12) United States Patent
Aviguetero, Jr.

(10) Patent No.: US 11,325,227 B2
(45) Date of Patent: May 10, 2022

(54) SPRINKLER HEAD REMOVAL AND INSTALLATION DEVICE

(71) Applicant: Fred C. Aviguetero, Jr., Koloa, HI (US)

(72) Inventor: Fred C. Aviguetero, Jr., Koloa, HI (US)

( * ) Notice: Subject to any disclaimer, the term of this patent is extended or adjusted under 35 U.S.C. 154(b) by 300 days.

(21) Appl. No.: 16/574,955

(22) Filed: Sep. 18, 2019

(65) Prior Publication Data

US 2021/0078143 A1 Mar. 18, 2021

(51) Int. Cl.

| | |
|---|---|
| ***B25B 13/50*** | (2006.01) |
| ***B25B 23/00*** | (2006.01) |
| ***B05B 15/60*** | (2018.01) |

(52) U.S. Cl.

CPC ..... *B25B 13/50* (2013.01); *B05B 15/60* (2018.02); *B25B 23/0035* (2013.01)

(58) Field of Classification Search

CPC ..... B25B 13/06; B25B 13/065; B25B 13/50; B25B 13/48

See application file for complete search history.

(56) References Cited

U.S. PATENT DOCUMENTS 1,397,876 A * 11/1921 Meldal ..... F16B 23/0007 411/427
D296,651 S * 7/1988 de Armas ..... A62C 35/68 D8/29
4,788,894 A 12/1988 Mitschele
6,044,732 A * 4/2000 Astle ..... B25B 13/02 81/124.2
6,234,411 B1 5/2001 Walker
6,564,679 B1 * 5/2003 Llamas ..... B25B 13/02 81/124.2
7,055,614 B1 * 6/2006 Ide ..... A62C 37/14 169/37
7,185,567 B2 3/2007 Ide
7,562,605 B2 * 7/2009 Kunkel ..... B25B 13/02 81/176.1
D689,352 S * 9/2013 Cecil ..... B25B 13/48 D8/29
8,997,323 B1 4/2015 Sanders
9,457,212 B2 * 10/2016 Williams ..... A62C 35/68
D799,924 S * 10/2017 Koiwa ..... F16B 23/0007 D8/29
2009/0301269 A1 * 12/2009 Wedge ..... B25B 13/48 81/124.2
2013/0020406 A1 * 1/2013 Koiwa ..... B25B 13/06 239/209

(Continued)

*Primary Examiner* — David B. Thomas

(57) ABSTRACT

A sprinkler head removal and installation device includes a tube that has a first end, which is closed, and a second end that is open. The tube has an inner diameter that is complementary to a diameter of a set of groves that is positioned in a top of a sprinkler head. Each of a plurality of teeth is coupled to and extends from the second end of the tube is configured to be inserted into a respective groove of the set of grooves as the top of a sprinkler head is partially inserted into the tube through the second end. An aperture that is centrally positioned in the first end of the tube is configured for insertion of a drive of a socket wrench, positioning a user to selectively turn the socket wrench to remove and install the sprinkler head.

17 Claims, 5 Drawing Sheets

(56) References Cited

U.S. PATENT DOCUMENTS

| | | | | |
|---|---|---|---|---|
| 2014/0150612 | A1* | 6/2014 | Cecil | F16B 23/0076 81/121.1 |
| 2015/0202748 | A1 | 7/2015 | Trudeau | |
| 2016/0169491 | A1* | 6/2016 | Gurwicz | B25B 13/48 81/460 |
| 2017/0219189 | A1* | 8/2017 | Gurwicz | F21V 21/36 |
| 2017/0232586 | A1* | 8/2017 | Gurwicz | B25B 13/48 29/854 |

* cited by examiner

SPRINKLER HEAD REMOVAL AND INSTALLATION DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relate to removal and installation devices and more particularly pertain to a new removal and installation device for a sprinkler head.

BRIEF SUMMARY OF THE INVENTION

An embodiment of the disclosure meets the needs presented above by generally comprising a tube that has a first end, which is closed, and a second end that is open. The tube has an inner diameter that is complementary to a diameter of a set of groves that is positioned in a top of a sprinkler head. Each of a plurality of teeth is coupled to and extends from the second end of the tube is configured to be inserted into a respective groove of the set of grooves as the top of a sprinkler head is partially inserted into the tube through the second end. An aperture that is centrally positioned in the first end of the tube is configured for insertion of a drive of a socket wrench, positioning a user to selectively turn the socket wrench to remove and install the sprinkler head.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
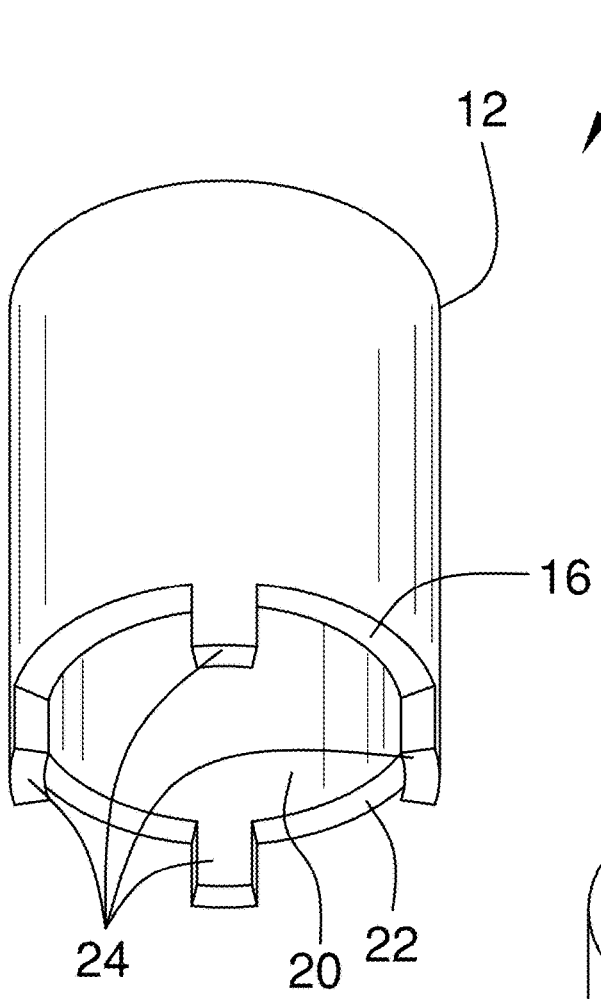
FIG. 1 is an isometric perspective view of a sprinkler head removal and installation device according to an embodiment of the disclosure.

With reference now to the drawings, and in particular to FIGS. 1 through 7 thereof, a new removal and installation device embodying the principles and concepts of an embodiment of the disclosure and generally designated by the reference numeral 10 will be described.

As best illustrated in FIGS. 1 through 7, the sprinkler head removal and installation device 10 generally comprises a tube 12 that has a first end 14, which is closed, and a second end 16 that is open. The tube 12 has an inner diameter 18 that is complementary to a diameter of a set of groves that is positioned in a top of a sprinkler head.

The inner diameter 18 measures from 2.22 to 6.66 centimeters. The inner diameter 18 may measure 4.44 centimeters. The first end 14 and the second end 16 of the tube 12 are separated by from 2.54 to 7.62 centimeters. The first end 14 and the second end 16 may be separated by 5.08 centimeters. A wall 20 of the tube 12 has a thickness 22 of from 20.0 to 50.0 millimeters. The wall 20 of the tube 12 may have a thickness 22 of 32.0 millimeters.

Figure 7:
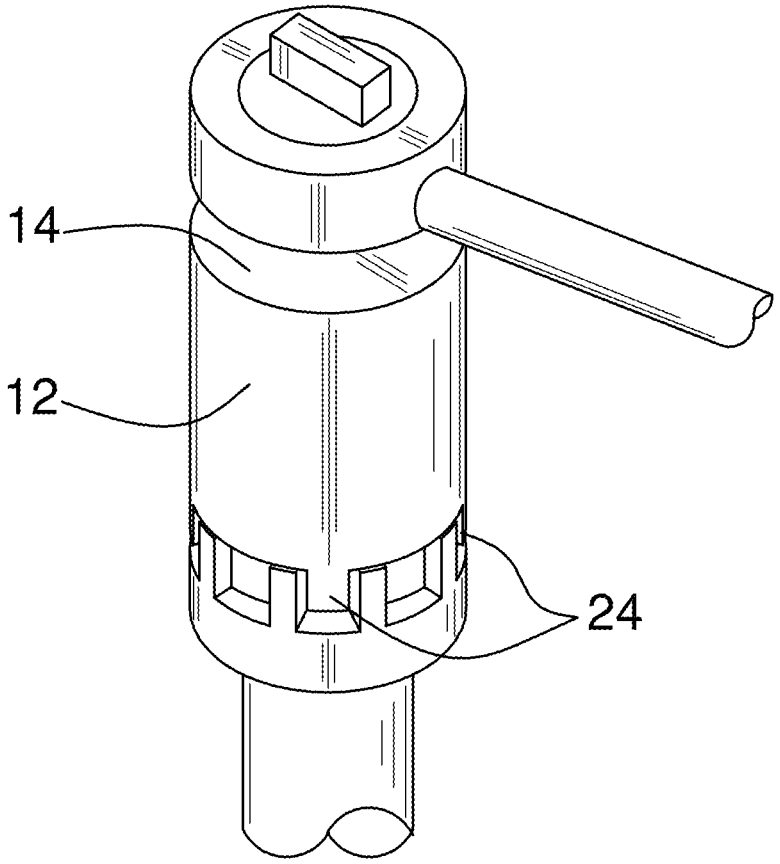
FIG. 7 is an in-use view of an embodiment of the disclosure.

Each of a plurality of teeth 24 that is coupled to and extends from the second end 16 of the tube 12 is configured to be inserted into a respective groove of the set of grooves as the top of a sprinkler head is partially inserted into the tube 12 through the second end 16, as shown in FIG. 7.

The plurality of teeth 24 comprises from two to ten teeth 24. The plurality of teeth 24 may comprise from three to eight teeth 24. The plurality of teeth 24 may comprise four teeth 24 that are evenly spaced around a perimeter 26 of the second end 16 of the tube 12 so that the teeth 24 are selectively alternatingly positionable into the grooves of a set of eight grooves.

Each tooth 24 extends from 15.0 millimeters to 63.5 millimeters from the second end 16 of the tube 12. Each tooth 24 may extend 31.8 millimeters from the second end 16 of the tube 12. Each tooth 24 has a width 28 of 40.0 to 85.0 millimeters. Each tooth 24 may have a width 28 of 63.5 millimeters.

The plurality of teeth 24 and the tube 12 may comprise metal, or other rigid material, such as, but not limited to, plastic and the like. The plurality of teeth 24 and the tube 12 may comprise stainless steel.

Figure 2:
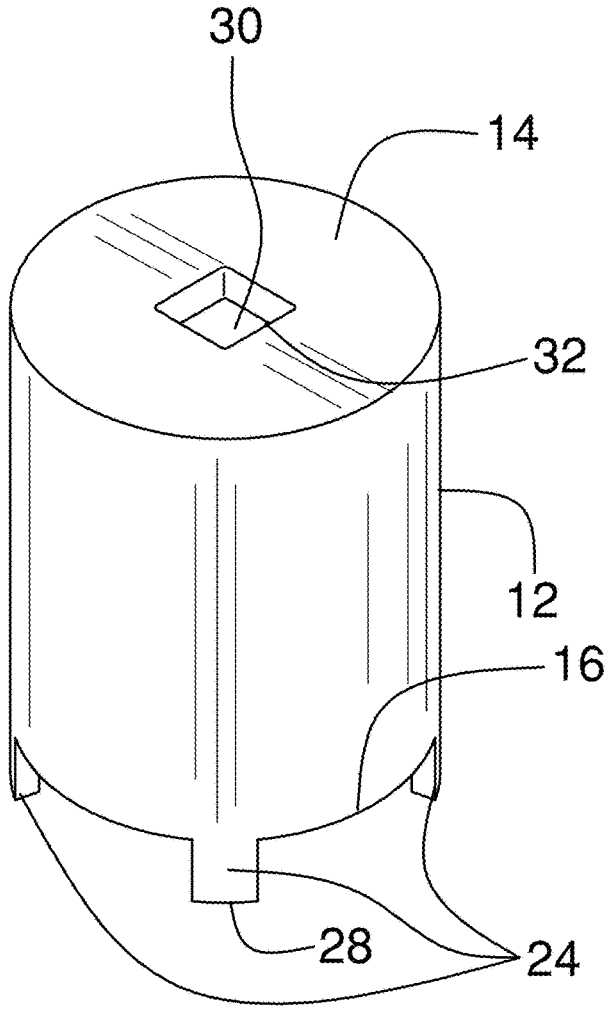
FIG. 2 is an isometric perspective view of an embodiment of the disclosure.
Figure 3:
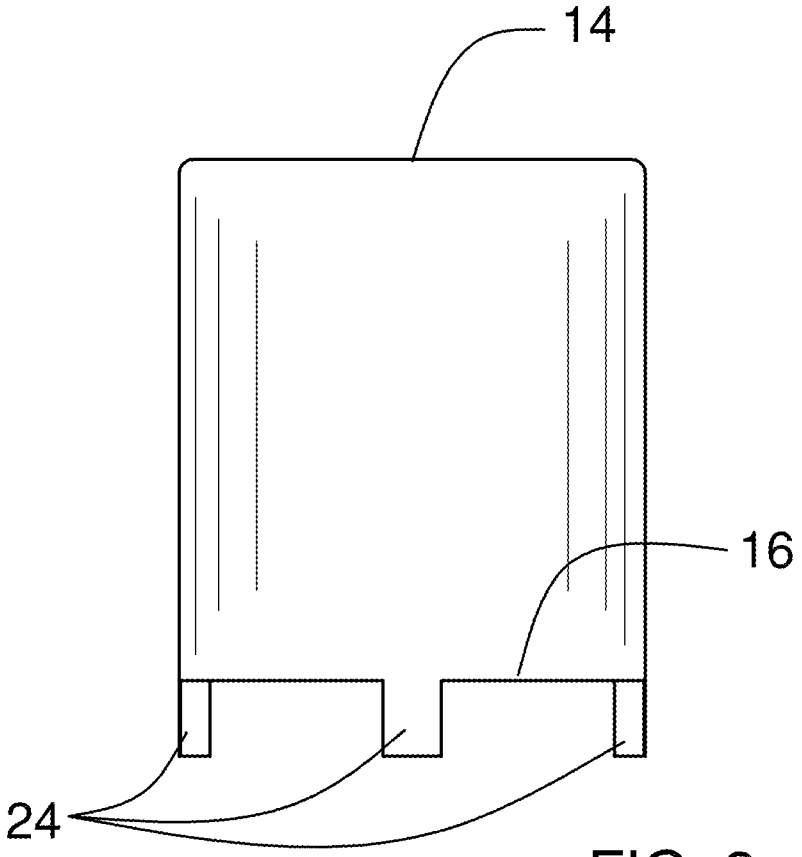
FIG. 3 is a side of an embodiment of the disclosure.
Figure 4:
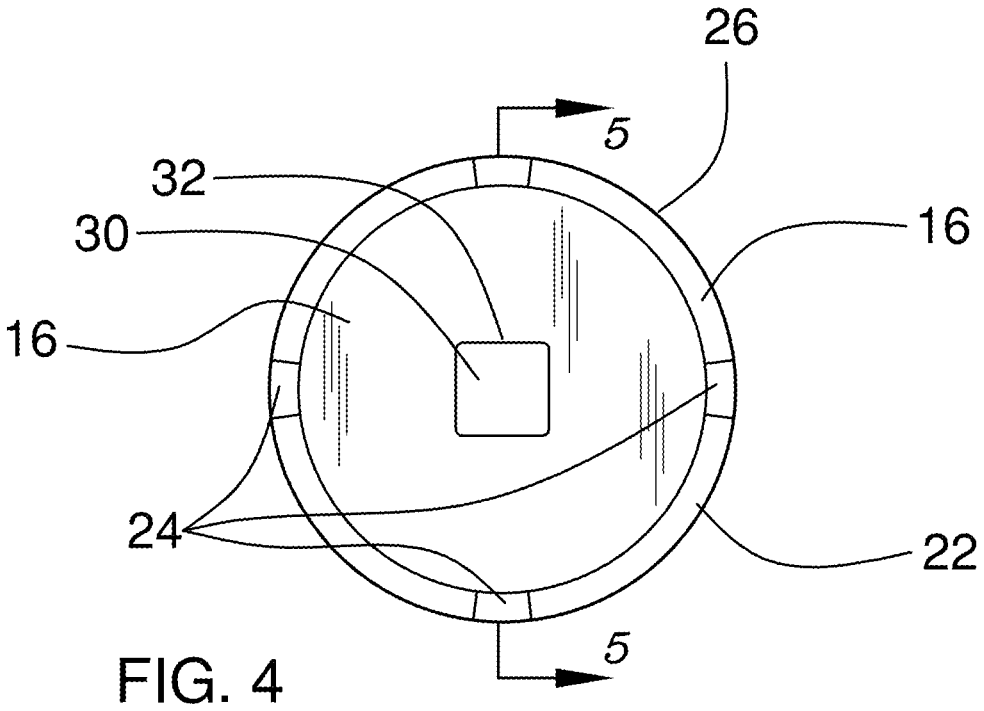
FIG. 4 is a bottom view of an embodiment of the disclosure.
Figure 5:
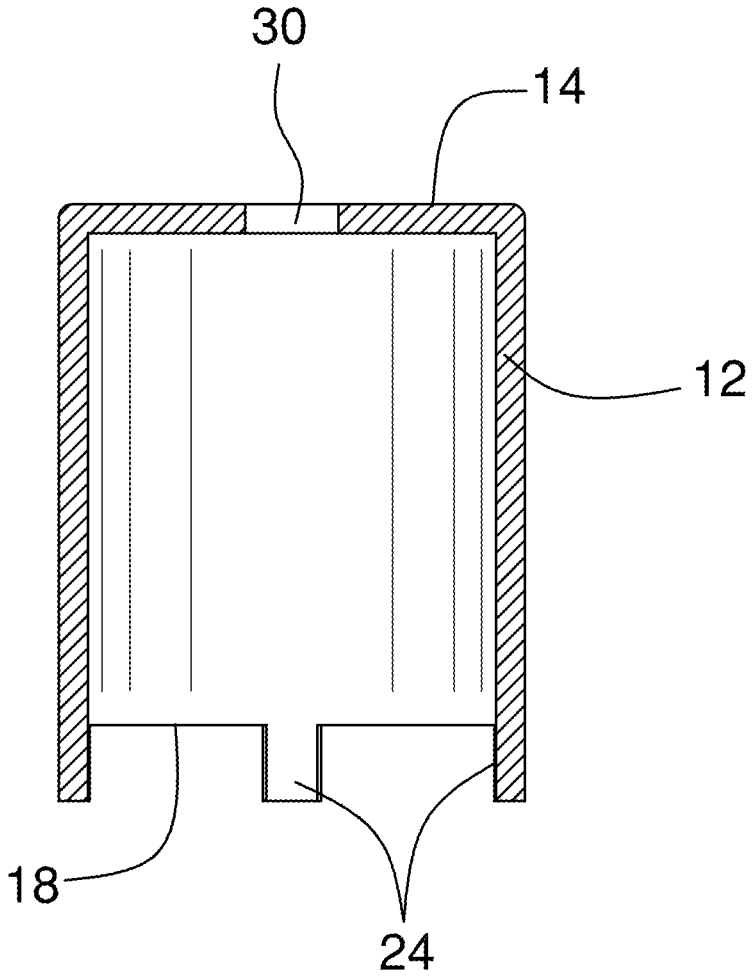
FIG. 5 is a cross-sectional view of an embodiment of the disclosure.
Figure 6:
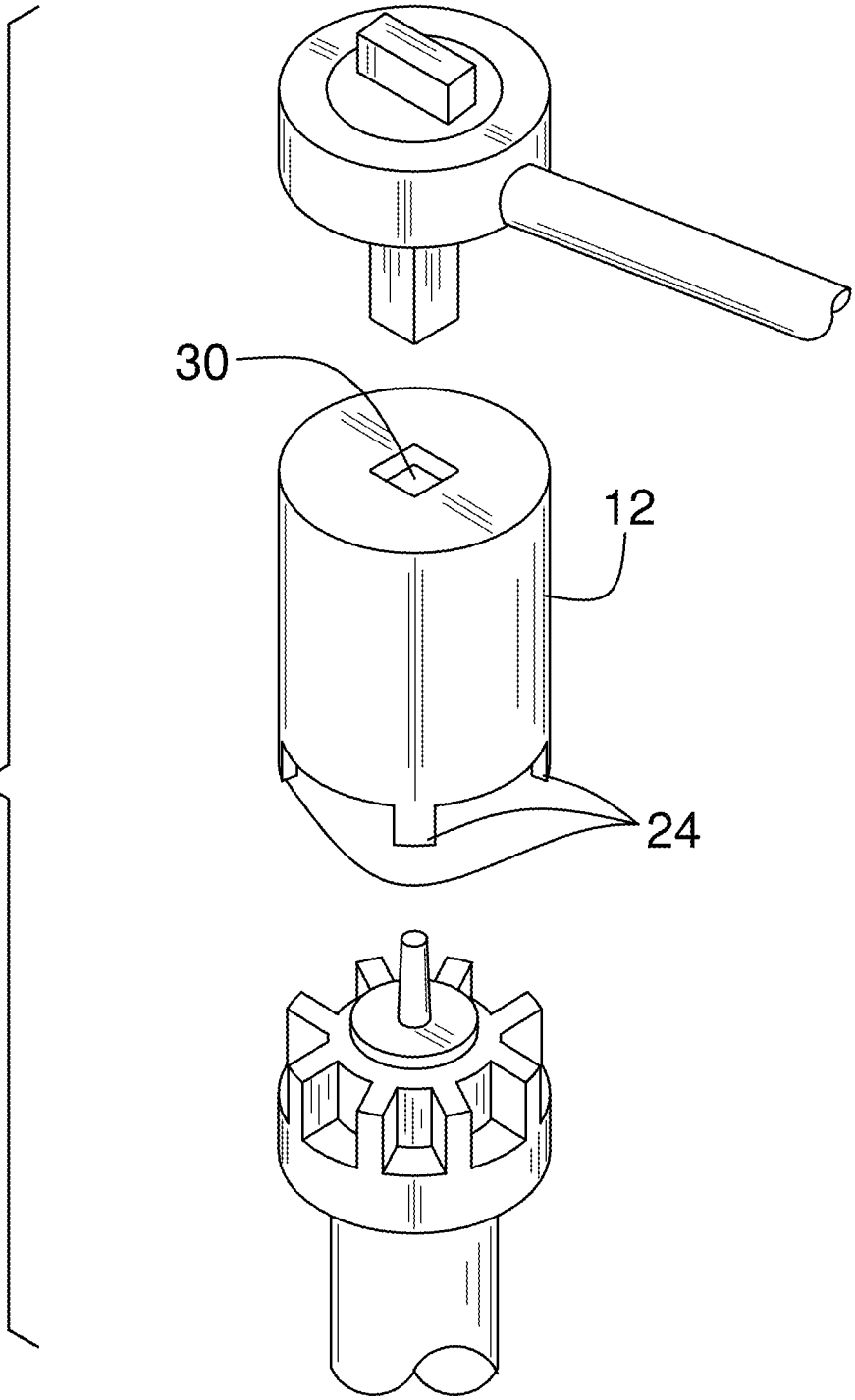
FIG. 6 is an in-use view of an embodiment of the disclosure.

An aperture 30 that is centrally positioned in the first end 14 of the tube 12, as shown in FIG. 2, is configured for insertion of a drive of a socket wrench, as shown in FIG. 6. A user is positioned to selectively turn the socket wrench to remove and install the sprinkler head.

The aperture 30 is squarely shaped, with each side 32 of the aperture 30 measuring at least one of 6.3 millimeters, 9.5 millimeters, 12.5 millimeters, and 19.0 millimeters. Each side 32 of the aperture 30 may measure 9.5 millimeters. The device 10 is anticipated to be particularly useful for removal and installation a Toro® brand sprinkler head as this brand of sprinkler head fastens to a ⅜ inch (19.00 millimeter) drive.

In use, the drive of the socket wrench is inserted into the aperture 30 to couple the device 10 to the socket wrench. The user then partially inserts the top of the sprinkler head into the tube 12 through the second end 16 so that the plurality of teeth 24 engages the set of grooves that is positioned on the top of the sprinkler head. Should the sprinkler head be positioned below grade and be unreachable when the device 10 is coupled directly to the drive, an extension can be positioned between the device 10 and the drive. The user then is positioned to selectively turn the socket wrench to remove and install the sprinkler head.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sprinkler head removal and installation device comprising: a tube having a first end and a second end, the first end being closed, the second end being open, the first end of the tube having a circumference equal to a circumference of the second end of the tube, the first end of the tube being planar within the circumference of the first end of the tube, the tube having an inner diameter complementary to a diameter of a set of groves positioned in a top of a sprinkler head; a plurality of teeth coupled to and extending from the second end of the tube wherein each tooth is configured for inserting into a respective groove of the set of grooves as the top of a sprinkler head is partially inserted into the tube through the second end; and an aperture centrally positioned in the first end of the tube wherein the aperture is configured for inserting a drive of a socket wrench positioning a user for selectively turning the socket wrench for removing and installing the sprinkler head.

2. The device of claim 1, further including the inner diameter measuring from 2.22 to 6.66 centimeters.

3. The device of claim 2, further including the inner diameter measuring 4.44 centimeters.

4. The device of claim 1, further including the first end and the second end of the tube being separated by from 2.54 to 7.62 centimeters.

5. The device of claim 4, further including the first end and the second end being separated by 5.08 centimeters.

6. The device of claim 1, further including a wall of the tube having a thickness of from 20.0 to 50.0 millimeters.

7. The device of claim 6, further including the wall of the tube having a thickness of 32.0 millimeters.

8. The device of claim 1, further including the plurality of teeth comprising from two to ten teeth.

9. The device of claim 8, further including the plurality of teeth comprising from three to eight teeth.

10. The device of claim 9, further including the plurality of teeth comprising four teeth, the plurality of teeth being evenly spaced around a perimeter of the second end of the tube such that the teeth are selectively alternatingly positionable in the grooves of a set of eight grooves.

11. The device of claim 1, further comprising:

each tooth extending from 15.0 millimeters to 63.5 millimeters from the second end of the tube; and each tooth having a width of 40.0 to 85.0 millimeters.

12. The device of claim 11, further comprising:

each tooth extending 31.8 millimeters from the second end of the tube; and each tooth having a width of 63.5 millimeters.

13. The device of claim 1, further including the plurality of teeth and the tube comprising metal.

14. The device of claim 13, further including the plurality of teeth and the tube comprising stainless steel.

15. The device of claim 1, further including the aperture being squarely shaped, each side of the aperture measuring at least one of 6.3 millimeters, 9.5 millimeters, 12.5 millimeters, and 19.0 millimeters.

16. The device of claim 1, further including each side of the aperture measuring 9.5 millimeters.

17. A sprinkler head removal and installation device comprising:

a tube having a first end and a second end, the first end being closed, the second end being open, the first end of the tube having a circumference equal to a circumference of the second end of the tube, the first end of the tube being planar within the circumference of the first end of the tube, the tube having an inner diameter complementary to a diameter of a set of groves positioned in a top of a sprinkler head, the inner diameter measuring from 2.22 to 6.66 centimeters, the first end and the second end of the tube being separated by from 2.54 to 7.62 centimeters, a wall of the tube having a thickness of from 20.0 to 50.0 millimeters;

a plurality of teeth coupled to and extending from the second end of the tube wherein each tooth is configured for inserting into a respective groove of the set of grooves as the top of a sprinkler head is partially inserted into the tube through the second end, the plurality of teeth being four teeth, the plurality of teeth being evenly spaced around a perimeter of the second end of the tube such that the teeth are selectively alternatingly positionable in the grooves of a set of eight grooves, each tooth extending from 15.0 millimeters to 63.5 millimeters from the second end of the tube, each tooth having a width of 40.0 to 85.0 millimeters the plurality of teeth and the tube comprising stainless steel; and an aperture centrally positioned in the first end of the tube wherein the aperture is configured for inserting a drive of a socket wrench positioning a user for selectively turning the socket wrench for removing and installing the sprinkler head, the aperture being squarely shaped, each side of the aperture measuring at least one of 6.3 millimeters, 9.5 millimeters, 12.5 millimeters, and 19.0 millimeters.

* * * * *